US011413728B2

(12) United States Patent
Ponce et al.

(10) Patent No.: US 11,413,728 B2
(45) Date of Patent: Aug. 16, 2022

(54) TIGHTENING TOOL

(71) Applicant: Nissan North America, Inc., Franklin, TN (US)

(72) Inventors: Pedro R. Ponce, Toluca (MX); Guillermo Gonzalez, Toluca (MX)

(73) Assignee: NISSAN NORTH AMERICA, INC., Franklin, TN (US)

( * ) Notice: Subject to any disclaimer, the term of this patent is extended or adjusted under 35 U.S.C. 154(b) by 366 days.

(21) Appl. No.: 16/800,955

(22) Filed: Feb. 25, 2020

(65) Prior Publication Data

US 2021/0260731 A1 Aug. 26, 2021

(51) Int. Cl.
*B25B 13/50* (2006.01)
*B25B 13/06* (2006.01)

(52) U.S. Cl.
CPC ..... *B25B 13/50* (2013.01); *B25B 13/06* (2013.01)

(58) Field of Classification Search
CPC ..... B25B 13/50; B25B 13/06; B25B 27/0035; F16B 2/02; F16B 2/06
See application file for complete search history.

(56) References Cited

U.S. PATENT DOCUMENTS 1,895,280 A * 1/1933 Currie ..... B25B 13/04 81/118
3,008,363 A * 11/1961 Cook ..... B25B 13/463 81/185
4,984,489 A * 1/1991 Krauthamer ..... B25B 13/50 81/124.2
6,923,096 B1 * 8/2005 Kim ..... B25B 13/12 81/125
7,389,713 B1 * 6/2008 Chen ..... B25B 13/44 81/155
2002/0159830 A1 * 10/2002 Fries ..... B23H 9/003 403/374.4
2007/0245859 A1 * 10/2007 Williams ..... B25B 27/0035 81/125
2011/0233949 A1 * 9/2011 Petit ..... B25B 13/5066 294/102.1
2012/0131777 A1 * 5/2012 Holtzman ..... A63B 60/00 29/239
2012/0230758 A1 * 9/2012 Widenmeyer ..... F16D 1/0847 403/290

OTHER PUBLICATIONS

Professional Wireless S3453 Antenna Clamp, http://www.taiaudio.com/professional-wireless-s3453-antenna-clamp/, 2019.

* cited by examiner

*Primary Examiner* — David B. Thomas
(74) *Attorney, Agent, or Firm* — Global IP Counselors, LLP

(57) ABSTRACT

A rod tightening tool includes an elongated member, a clamping assembly and a wrench attachment end. The elongated member has a semi-hollow interior and defines an opening at one end thereof providing access to the semi-hollow interior. The elongated member has a slot formed along a portion thereof that extends to the semi-hollow interior. The clamping assembly has a first member and a second member. The first member is installed for sliding movement along an exterior surface of the elongated member. The second member is installed to the first member such that the first and second members clamp to the elongated member. The wrench attachment end is fixedly attached to the elongated member.

20 Claims, 10 Drawing Sheets

TIGHTENING TOOL

BACKGROUND

Field of the Invention

The present invention generally relates to a tightening tool. More specifically, the present invention relates to tightening tool that clamps to an elongated rod, such as a vehicle antenna such that the elongated rod can be installed and tightened to a corresponding threaded member.

Background Information

Elongated elements, such as a vehicle antenna, that are threadedly attached to another member can be difficult to torque to predetermined specifications.

SUMMARY

One object of the present disclosure is to provide a tool that clamps about an elongated rod such that the elongated rod can be installed and tightened to a corresponding threaded member In view of the state of the known technology, one aspect of the present disclosure is to provide a rod tightening tool with an elongated member, a clamping member and a wrench attachment end. The elongated member has a semi-hollow interior and defines an opening at one end thereof providing access to the semi-hollow interior. The elongated member has a slot formed along a portion thereof that extends to the semi-hollow interior. The clamping assembly has a first member and a second member. The first member is installed for sliding movement along an exterior surface of the elongated member. The second member is installed to the first member such that the first and second members clamp to the elongated member. The wrench attachment end is fixedly attached to the elongated member.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Figure 1:
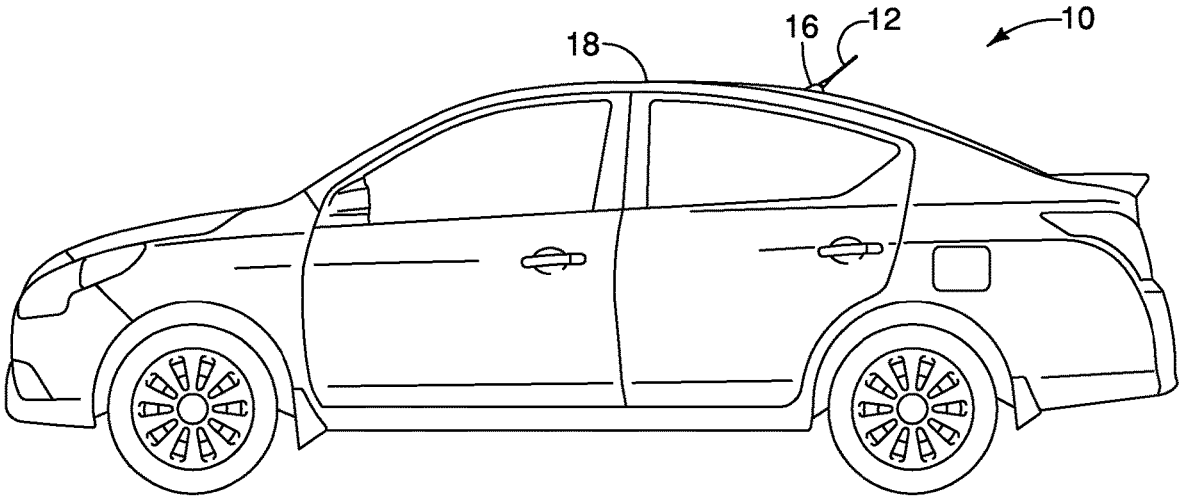
FIG. 1 is a side view of a vehicle that includes an antenna installed to a rearward area of a roof structure in accordance with a first embodiment.

Referring initially to FIG. 1, a vehicle 10 having an antenna 12 that is installed to the vehicle 10 using a tightening tool 14 (FIG. 2) is illustrated in accordance with a first embodiment.

As shown in FIGS. 1-4, the vehicle 10 includes an antenna mounting fixture 16 that is fixedly install led to, for example, a roof structure 18 of the vehicle 10 in a conventional manner. It should be understood from the drawings and the description herein that the antenna 12 and antenna mounting fixture 16 can be installed at various locations on a vehicle, such as a fender, trunk lid or pillar areas of the vehicle, and is not limited to installation to the roof structure of a vehicle.

Figure 3:
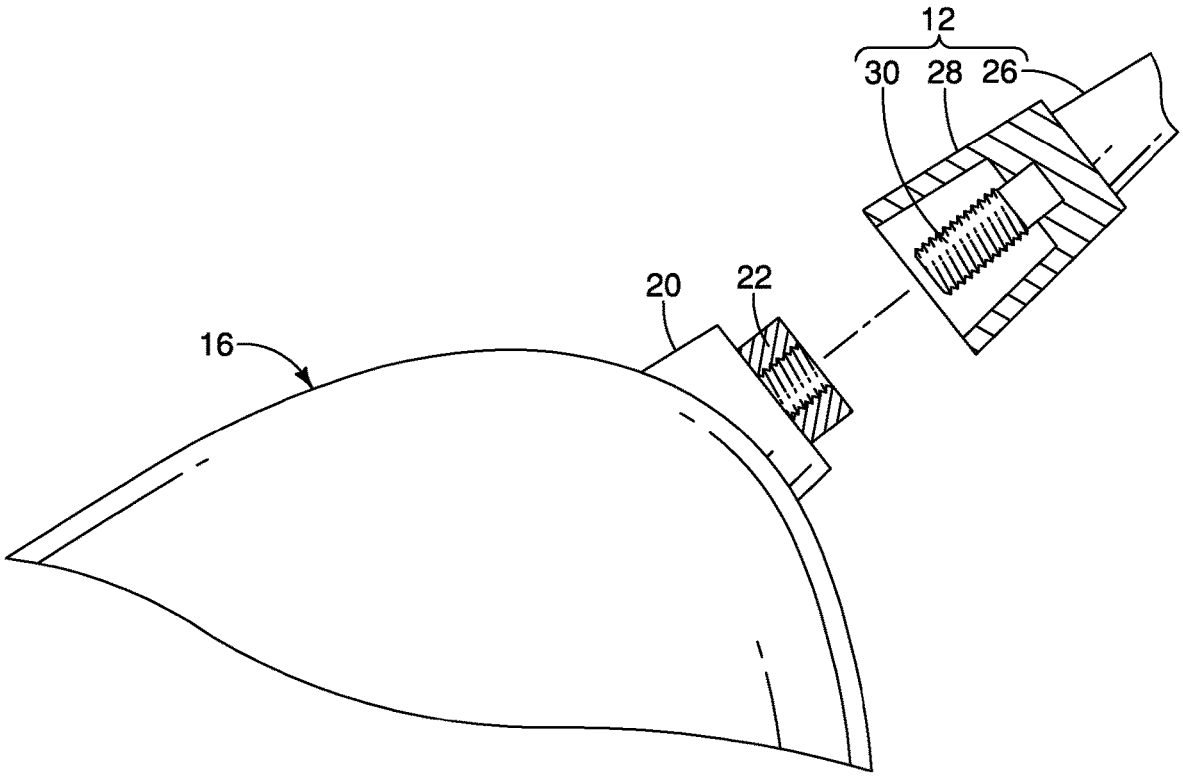
FIG. 3 is another exploded side view of the rod portion of the antenna just prior to installation to the antenna mounting fixture showing a threaded fastener of the rod portion and a corresponding threaded fastener of the antenna mounting fixture in accordance with the first embodiment.
Figure 4:
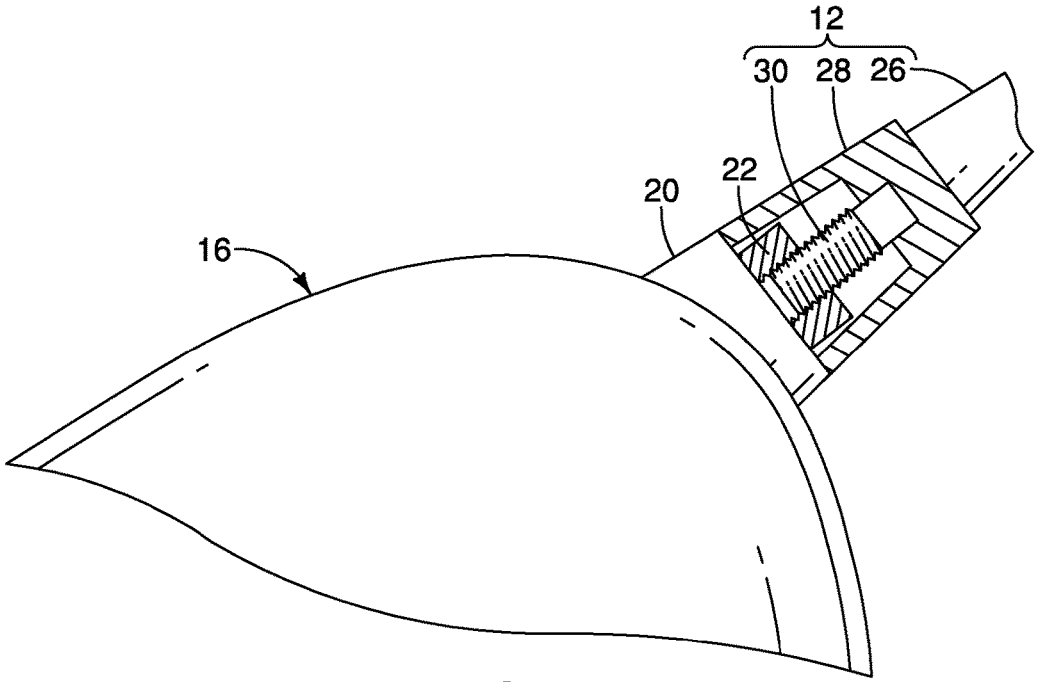
FIG. 4 is another side view of the antenna showing the rod portion installed to the antenna mounting fixture showing the threaded fastener of the rod portion engaged and torqued to the corresponding threaded fastener of the antenna mounting fixture in accordance with the first embodiment.

As shown in FIGS. 3 and 4, the antenna mounting fixture 16 includes a base portion 20 and an internally threaded fastening portion 22. The antenna 12 includes a rod portion 26, a sealing portion 28 and an externally threaded portion 30. As shown in FIG. 4, once the antenna 12 is installed to the antenna mounting fixture 16, the externally threaded portion 30 is threadedly engaged with the internally threaded fastening portion 22, fixing the antenna 12 to the vehicle 10. Further, when the antenna 12 is properly torqued in place, the sealing portion 28 creates a seal between the base portion 20 of the antenna mounting fixture 16 and the antenna 12, thereby protecting the threaded connection between the antenna 12 and the antenna mounting fixture 16.

The tightening tool 14 is designed to clamp onto the rod portion 26 of the antenna 12 so that the antenna 12 can be tightened to a predetermined torque thereby securely attaching the antenna 12 to the antenna mounting fixture 16.

Figure 5:
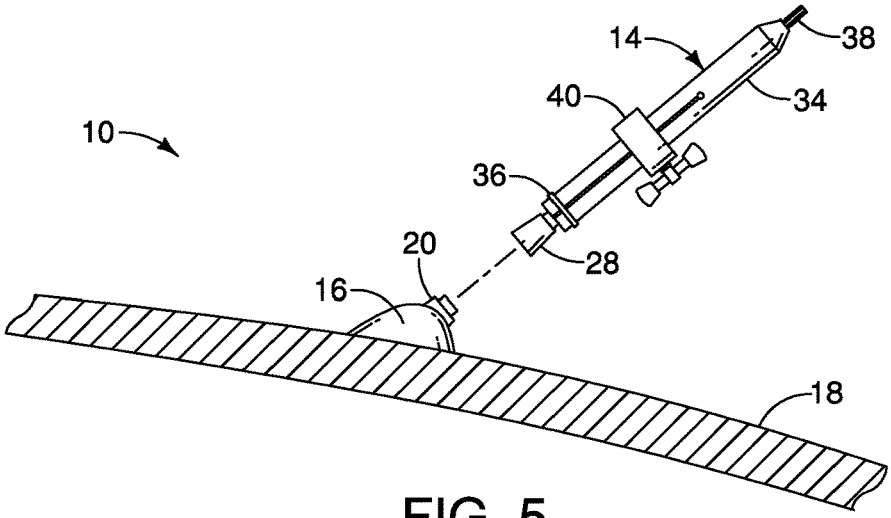
FIG. 5 is a side view similar to FIG. 2 showing the rod portion of the antenna inserted into a hollow interior of the tightening tool just prior to installation of the antenna mounting fixture, with a clamping member of the tightening tool in an unclamped orientation in accordance with the first embodiment.
Figure 6:
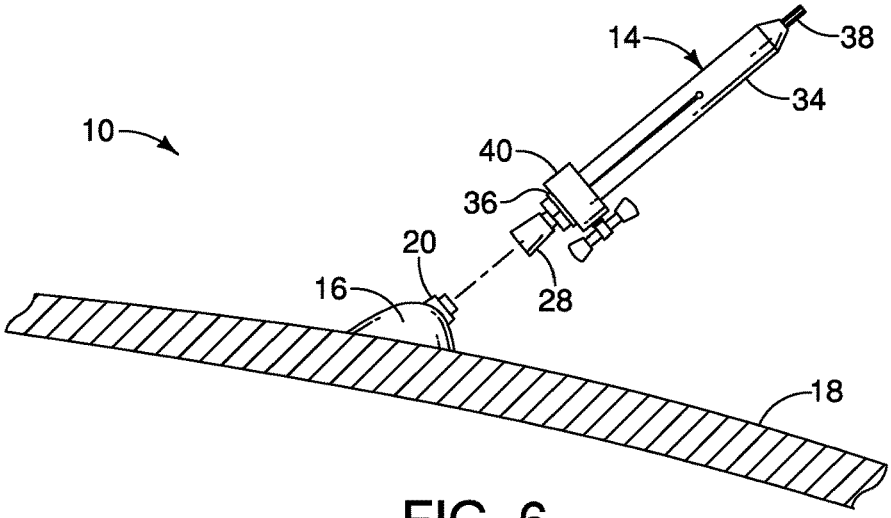
FIG. 6 is another side view similar to FIGS. 2 and 5 showing the rod portion of the antenna inserted into the hollow interior of the tightening tool just prior to installation of the antenna mounting fixture, with the clamping member of the tightening tool moved to a first end of the tightening tool and in a clamped orientation firmly holding the rod portion of the antenna within the tightening tool in accordance with the first embodiment.
Figure 7:
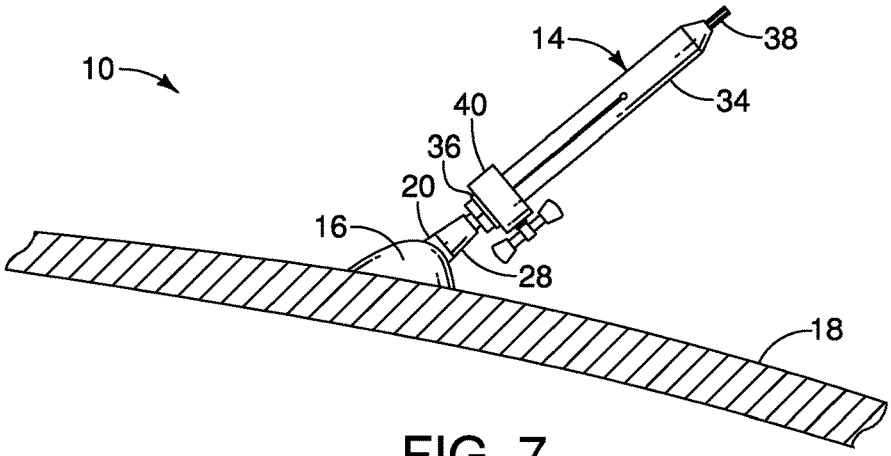
FIG. 7 is still another side view similar to FIGS. 2, 5 and 6 showing the rod portion of the antenna clamped within the hollow interior of the tightening tool during installation of the antenna mounting fixture during torqueing of the rod portion of the antenna to the antenna mounting fixture in accordance with the first embodiment.

Specifically, as shown in FIGS. 2, 5, 6 and 7, the rod portion 26 of the antenna 12 (shown in FIG. 2) is inserted into the tightening tool 14 as shown in FIG. 5. The tightening tool 14 is clamped to the rod portion 26 as shown in FIG. 6 in a manner described further below. The tightening tool 14 can then be rotated to apply the predetermined amount of torque to the antenna 12 as shown in FIG. 7.

The tightening tool 14 (also referred to as the rod tightening tool 14) basically an elongated member 34, a retaining member 36, a wrench attachment end 38 and a clamping assembly 40.

Figure 8:
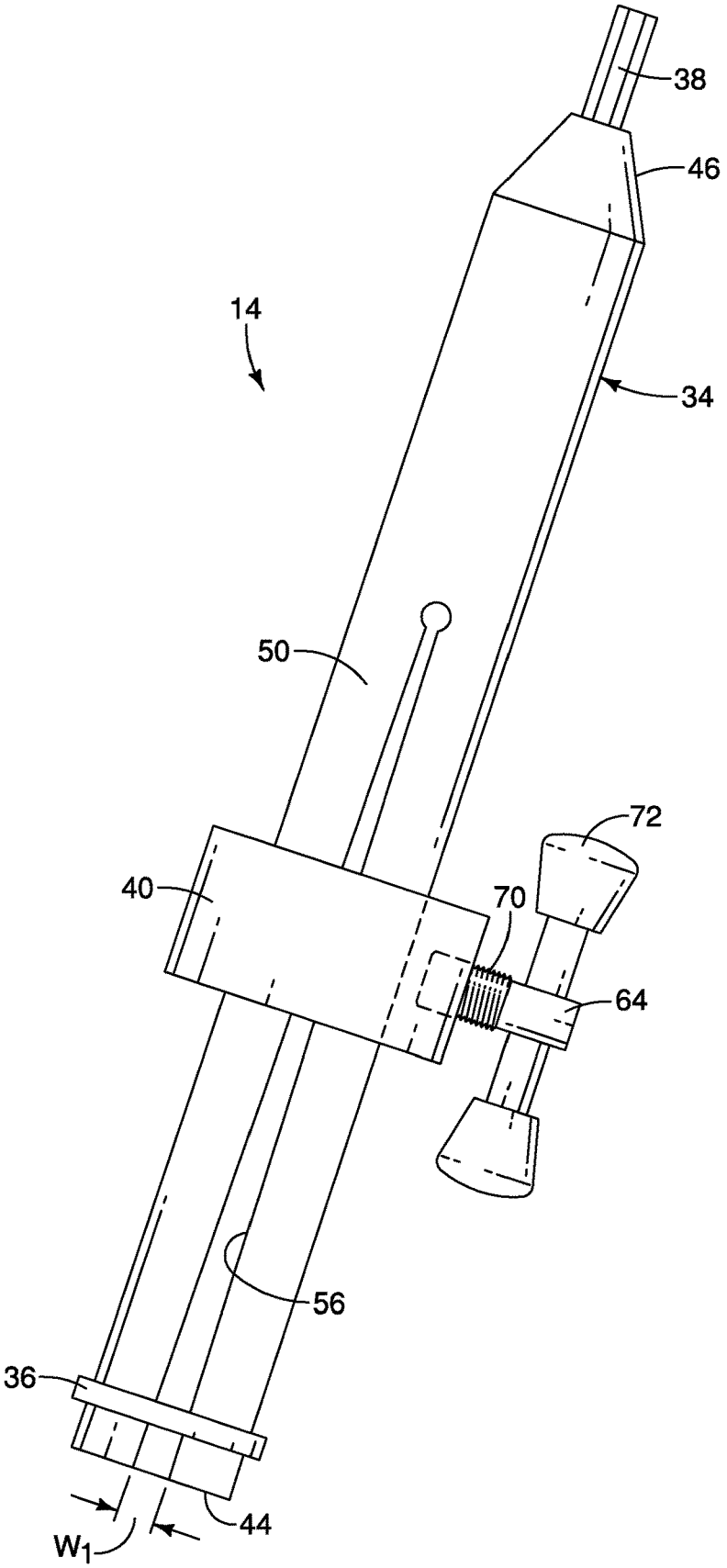
FIG. 8 is a side view of the tightening tool showing an elongated member, a retaining member, a wrench attachment end and the clamping assembly in an unclamping orientation in accordance with the first embodiment.
Figure 9:
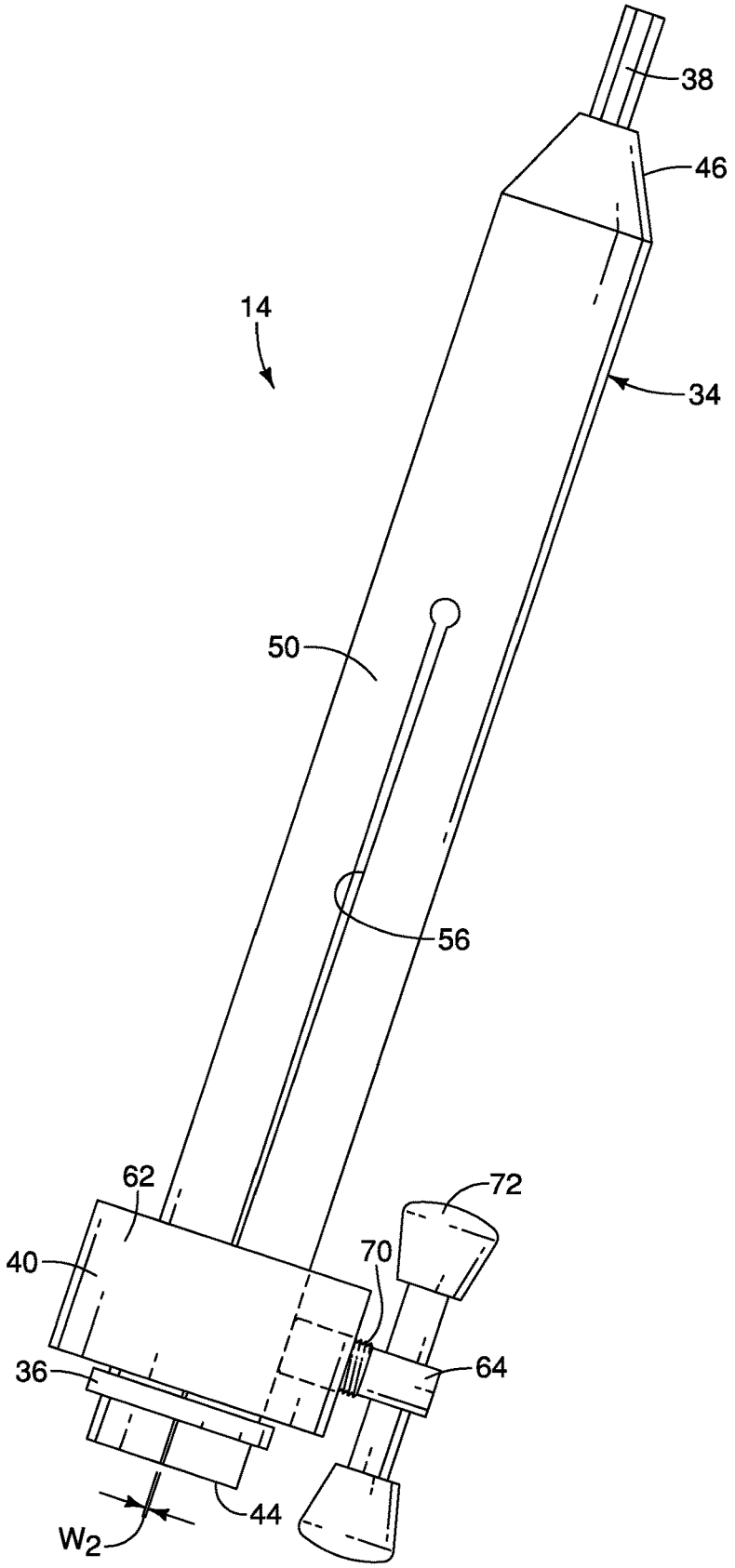
FIG. 9 is another side view of the tightening tool similar to FIG. 8 showing the clamping assembly slid to the first end of the elongated member and with the clamping member a clamped orientation in accordance with the first embodiment.
Figure 10:
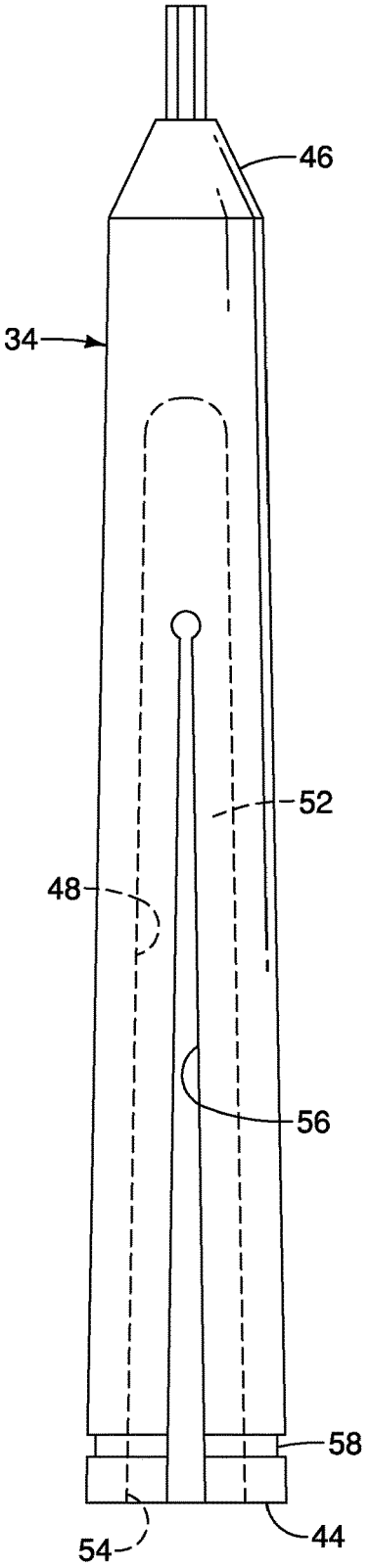
FIG. 10 is a side view of the elongated member shown with the retaining member ad the clamping assembly removed in accordance with the first embodiment.
Figure 11:
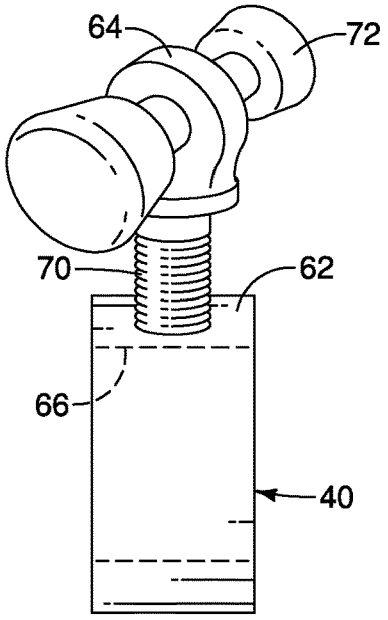
FIG. 11 is an end view of the clamping assembly removed from the elongated member showing a first member having an annular ring shape and a second member having a threaded portion and a handle portion in accordance with the first embodiment.
Figure 13:
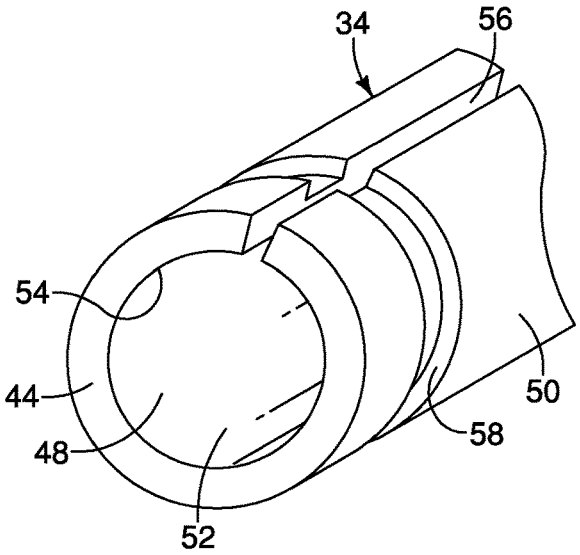
FIG. 13 is a perspective view of the first end of the elongated member showing the opening to the hollow interior thereof, a recess dimensioned to receive the retaining member and a single slot in accordance with the first embodiment.
Figure 14:
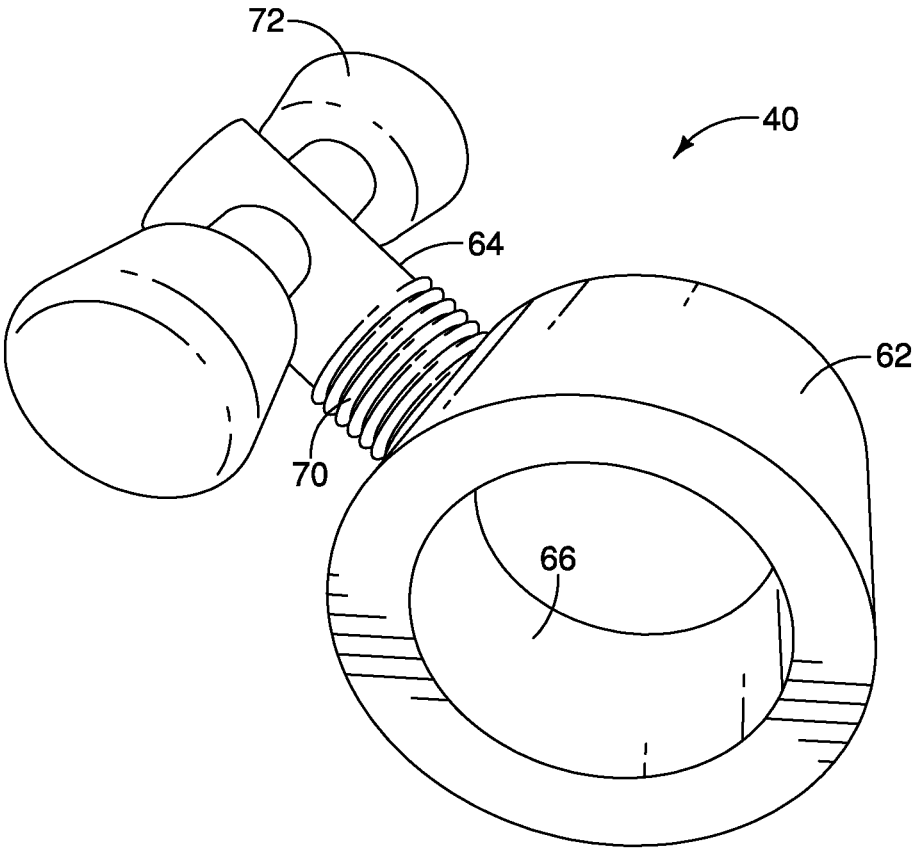
FIG. 14 is a perspective view of the clamping assembly removed from the elongated member showing the first member with the second member threaded into a radially extending threaded opening or bore thereof in accordance with the first embodiment.
Figure 15:
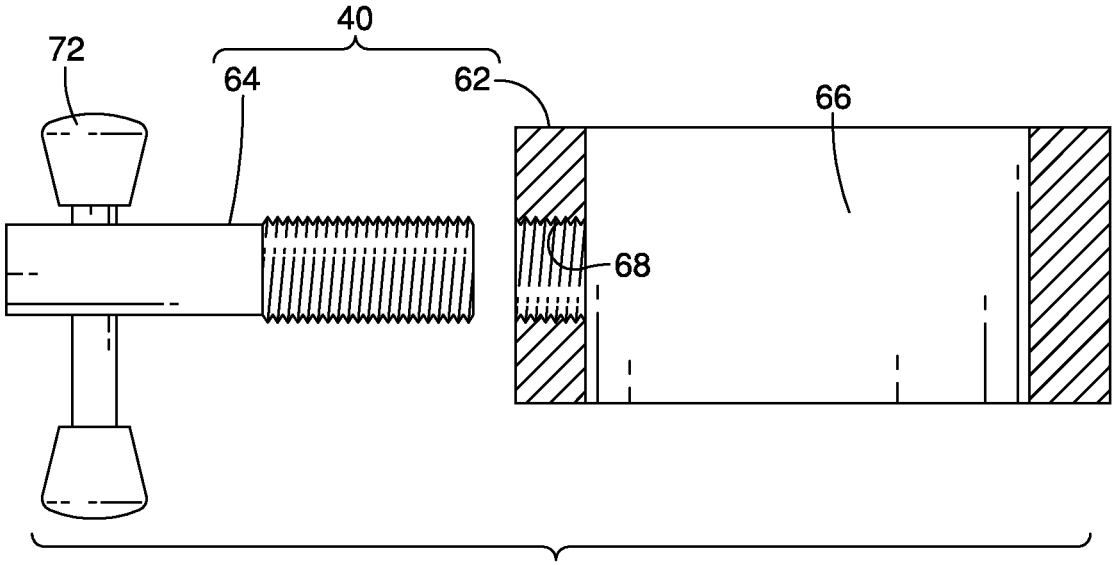
FIG. 15 is an exploded cross-sectional view of the clamping assembly showing the threaded opening or bore of the first member and the threaded portion of the second member in accordance with the first embodiment.
Figure 16:
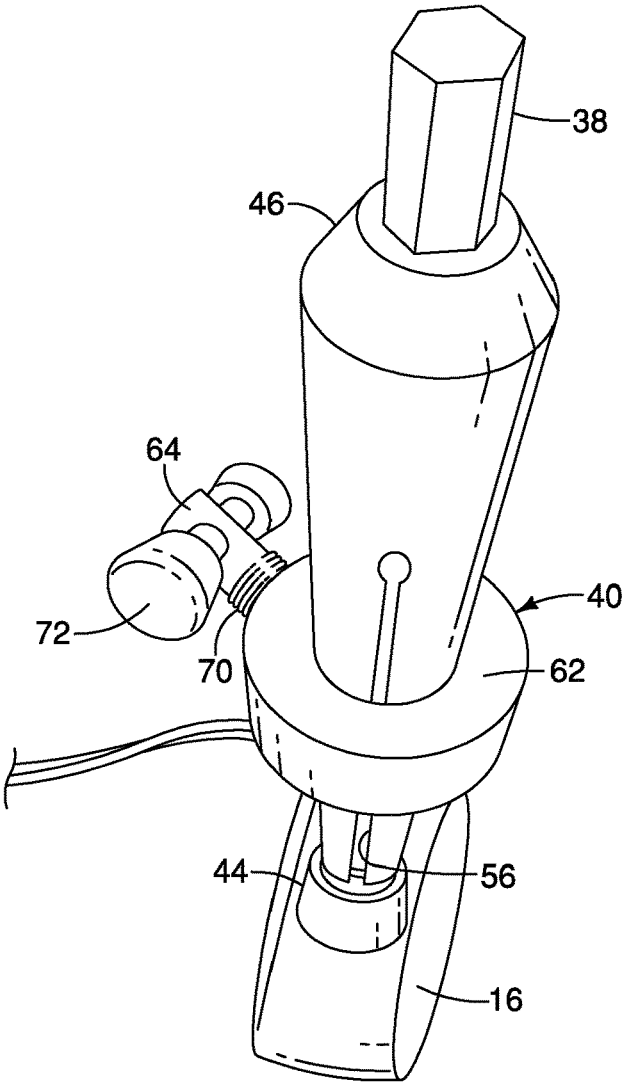
FIG. 16 is a perspective view of the tightening tool during installation of the rod portion of the antenna to the antenna mounting fixture in accordance with the first embodiment.
Figure 17:
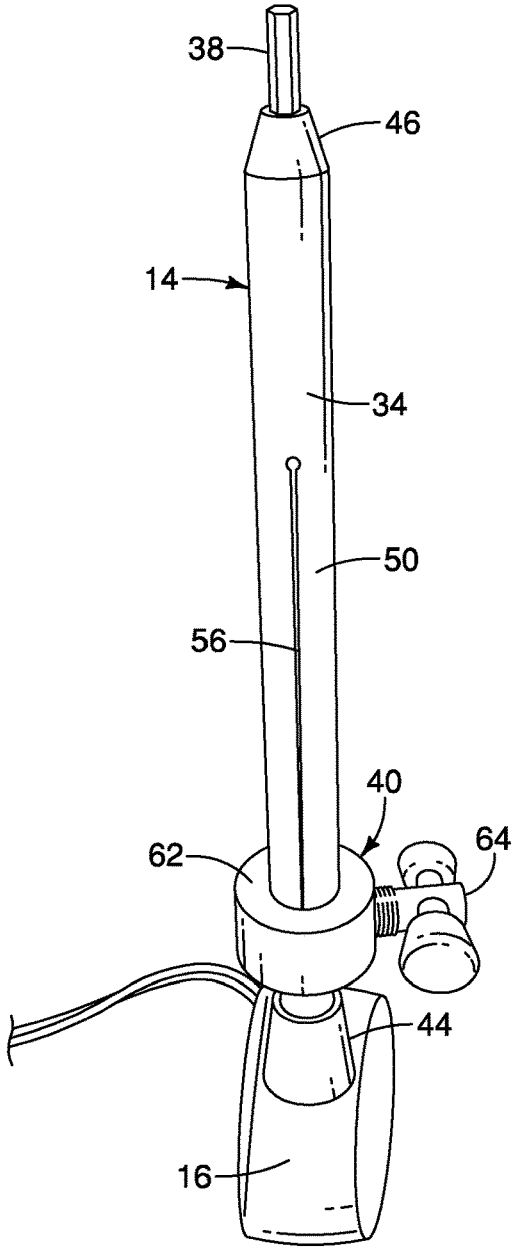
FIG. 17 is a rear view of the tightening tool during installation of the rod portion of the antenna to the antenna mounting fixture in accordance with the first embodiment.

As shown in FIGS. 8-10, the elongated member 34 has a first end 44, a second end 46, a cylindrically shaped inner surface 48 (in phantom in FIGS. 10 and 13) and a cylindrically shaped outer surface 50. The cylindrically shaped inner surface 48 defines a semi-hollow interior 52 with an opening 54 at the first end 44 thereof. The elongated member 34 also defines a slot 56 formed along a portion thereof that extends to the semi-hollow interior 52 between the inner surface 48 and the outer surface 50, and to the opening 54. The opening 54 exposes the semi-hollow interior 52, providing access thereto.

The outer surface 50 of the elongated member 34 defines an overall cylindrical shape but is not limited to this shape. For example, the elongated member 34 can have an oval shape (viewed in cross-section), a hexagonal shape or rectangular shape. The semi-hollow interior 52 of the elongated member 34 is dimensioned to receive the rod portion 26 of the antenna 12 therein such that the clamping assembly 40 clamps the inner surface 48 of the elongated member 34 to the rod portion 26 (also referred to as an elongated rod 26), as is described further below.

The slot 56 of the elongated member 34 has a first width $W_1$ proximate the opening 54 in the absence of clamping force by the clamping assembly 40, as shown in FIG. 8. With clamping force applied by the clamping assembly 40 to the elongated member 34, as shown in FIG. 9, the slot 56 proximate the opening 54 is reduced to a second width $W_2$ that is narrower than the first width $W_1$. In FIG. 9, the second width $W_2$ is negligible and is dependent upon the outer diameter of the rod portion 26 of the antenna 12 during a clamping procedure.

The elongated member 34 can be made of any of a variety of materials such as elastic polymers, plastics, or metal materials. One requirement of the material of the elongated member 34 is that the material must allow for sufficient elastic deformation so that the elongated member 34 can clamp to the rod portion 26 of the antenna 12 in response to force being applied by the clamping assembly 40. Further, the material of the elongated member 34 must be resilient so that the elongated member 34 returns to its non-deformed state as shown in FIG. 8. In other words, when the clamping assembly 40 elastically deform thereby narrowing the width of the slot 56, the elongated member 34 preferably springs back such that the slot 56 widens and returns to the width $W_1$, as shown in FIG. 8.

In the first embodiment, there is only one slot 56. However, it should be understood from the drawings and description herein that there can be two slots as shown in, for example the second embodiment shown in FIG. 18 and described further below.

Figure 12:
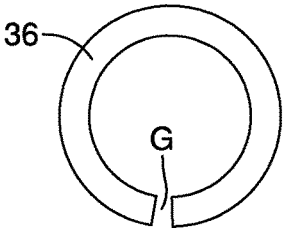
FIG. 12 is an end view of the retaining member removed from the elongated member and having an annular ring shape with an installation gap in accordance with the first embodiment.

The elongated member 34 further includes a recess 58 that extends around the outer surface 50 of the elongated member 34 proximate the opening 54. With the tightening tool 14 fully assembled, the retaining member 36 installed to the recess 58. The retaining member 36 can be a thick rubber-band like member or, as shown in FIG. 12, can be a C-type ring member that is loosely fitted into the recess 58. The retaining member 36 is provided as a stop member that limits movement of the clamping assembly 40 along the length of the elongated member 34. In other words, the retaining member 36 prevents the clamping assembly 40 from moving all the way to the first end 44 of the elongated member 34. Specifically, the retaining member 36 prevents the clamping assembly 40 from moving all the way to the first end 44 of the elongated member 34.

The retaining member 36 is dimensioned to remain in the recess 58 when the clamping assembly 40 fully clamps the elongated member 34, reducing the width of the slot 56, as shown in FIG. 9. The retaining member 36 can be made of an elastic material, such as plastic or a polymer material, and can further include a gap G. Alternatively, the retaining member 36 can be flexible annular ring without the gap G.

The wrench attachment end 38 is preferably fixedly attached to the second end 46 of the elongated member 34. For example, the wrench attachment end 38 can be embedded within the material used to form or machine the elongated member 34. Alternatively, the elongated member 34 and the wrench attachment end 38 can be unitarily formed as a single, monolithic element.

The wrench attachment end 38 is configured to receive a wrench (not shown) for applying torque to the elongated member 34 with the rod portion 26 of the antenna 12 clamped therein. In the depicted first embodiment, the wrench attachment end 38 has a hexagonal shape specifically dimensioned to receive a conventional socket wrench (not shown) that is attached to a torque wrench (not shown).

A description of the clamping member 40 is now provided with specific reference to FIGS. 8, 9, 11 and 14-17. The clamping assembly 40 has a first member 62 and a second member 64. The first member 62 has a central opening 66 that basically defines a central axis of the first member 62. In the depicted embodiment, the first member 62 has an overall annual ring shape. The central opening 66 is dimensioned to receive the elongated member 34 such that the first member 62 is slidable along the cylindrically shaped outer surface 50 of the elongated member 34 in the absence of clamping force. The first member 62 further includes a threaded bore 68 that extends in a radial direction from the central opening 66 through a portion of the annular shaped ring that defines the first member 62.

The second member 64 includes a screw portion or threaded portion 70 and a handle portion 72 that extends through an opening at one end of the threaded portion 70. The threaded portion 70 of the second member 64 has threads that mate with the threaded bore 68 of the first member 72 such that the second member 64 is threadedly installed to the threaded bore 68 of the first member 62. The first and second members 62 and 64 clamp to the elongated member 34 by tightening the second member 64 moving a distal end of the second member 64 into contact with the elongated member 34, reducing the width of the slot 56. Tightening of the second member 64 to the first member 62 clamps the rod portion 26 of the antenna 12 within the semi-hollow interior 52 of the elongated member 34.

Figure 2:
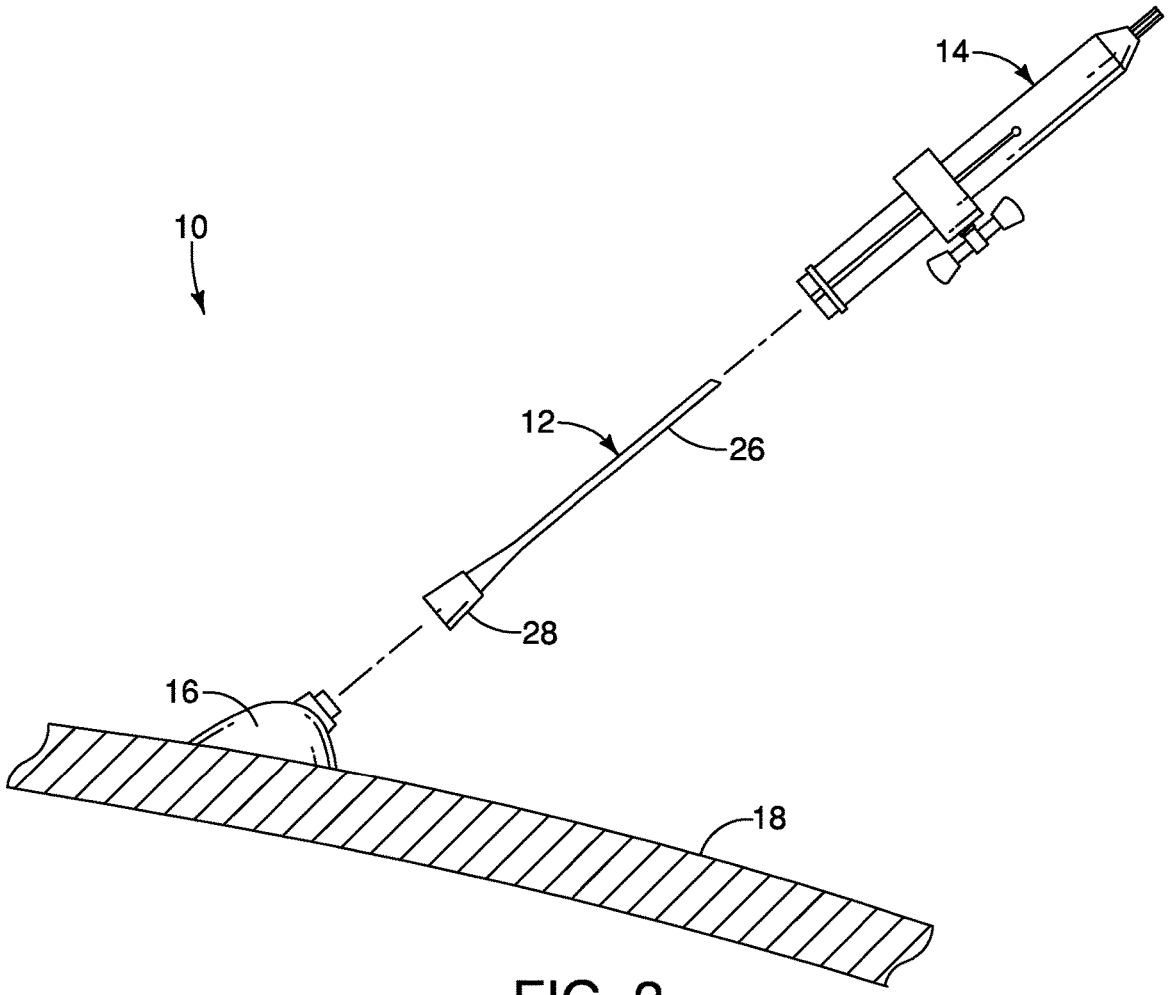
FIG. 2 is an exploded side view showing details of the antenna, including an antenna mounting fixture, a separate rod portion and a tightening tool for use in attaching and tightening the rod portion to the antenna mounting fixture in accordance with the first embodiment.

The sequence of drawings of FIGS. 2 and 5-9 show the basic steps of installation of the rod portion 26 of the antenna 12 to the antenna mounting fixture 16. As shown in FIGS. 2 and 5, the rod portion 26 of the antenna 12 is aligned with the tightening tool 14 (FIG. 2) and then inserted into the hollow interior 52 (FIG. 5). In FIGS. 5 and 8, the clamping assembly 40 is shown centrally positioned relative to a lengthwise direction of the elongated member 34. As shown in FIGS. 6 and 9, the clamping assembly 40 is moved to the first end 44 of the elongated member 34 and can be tightened. Movement of the clamping assembly 40 toward the first end 44 of the elongated member 34 is stopped or restricted by contact with the retaining member 36.

In FIG. 8, the clamping assembly 40 is not tightened such that the slot 56 has the width $W_1$ thereby allowing insertion and removal of the rod portion 26 of the antenna 12. Put another way, the internal diameter of the hollow interior 52 is at a maximum. However, as shown in FIGS. 7 and 9, rotation of the second member 64 causes the distal end of the second member 64 to press against the outer surface 50 of the elongated member 34 reducing the width of the slot 56 and thereby causing the inner surface 48 of the elongated member 34 to clamp the rod portion 26 of the antenna 12 within the hollow interior 52 of the elongated member 34. In other words, the force applied to the elongated member 34 by the clamping assembly 40 reduces the inner diameter of the hollow interior 52 of the elongated member 34.

As shown in FIG. 7, the externally threaded portion 30 of the antenna 12 can be attached to the internally threaded fastening portion 22 and then torqued to a predetermined level of tightness, fixing the rod portion 26 to the antenna mounting fixture 16. A torque wrench (not shown) can be attached to the wrench attachment end 38 in order to torque the rod portion 26 to the antenna mounting fixture 16. Since torque wrenches are conventional tools, further description of torque wrenches is omitted for the sake of brevity.

Second Embodiment

Figure 18:
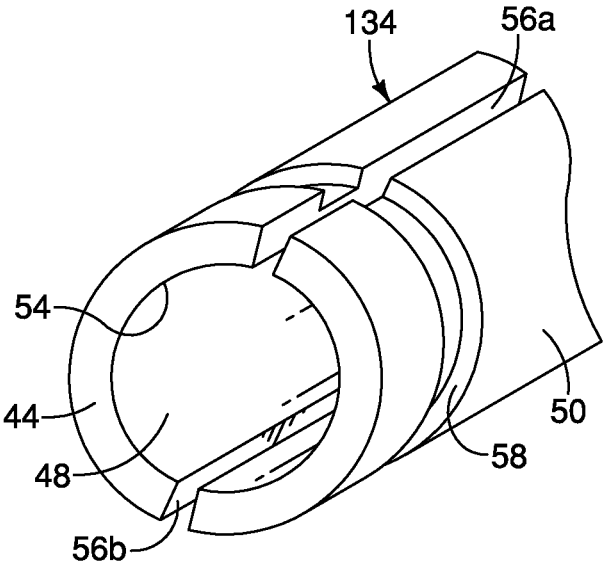
FIG. 18 is a perspective view of a first end of an elongated member of an antenna showing an opening to a hollow interior thereof, a recess dimensioned to receive the retaining member and a pair of slots in accordance with a second embodiment.

Referring now to FIG. 18 an elongated member 134 in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

The elongated member 134 replaces the elongated member 34 of the first embodiment in the tightening tool 14. In the second embodiment the tightening tool 14 is identical to the second embodiment, except that the elongated member 134 includes a pair of slots 56*a* and 56*b*. The slots 56*a* and 56*b* are formed on opposite sides of the elongated member 134. Hence, the only difference between the tightening tool 14 of the first embodiment and the second embodiment is that the elongated member 34 of the first embodiment only has one slot 56 and the elongated member 134 of the second embodiment includes two slots, slots 56*a* and 56*b*.

The tightening tool 14 can be manufactured from any of a variety of materials. For example, the elongated member 34 can be made of a plastic or polymer material that is flexible and resilient. As such, only one slot 56 should be necessary in order to provide the flexibility to be repeatedly clamped by the clamping assembly 40 to the rod portion 26 of the antenna. In the second embodiment, the elongated member 134 can be made of plastic, polymer material, metal or metal alloys. If the material is too rigid for repeated compression with only one slot, the two slots 56*a* and 56*b* can provide the flexibility necessary for repeated clamping and unclamping by the clamping assembly 40.

Third Embodiment

Figure 19:
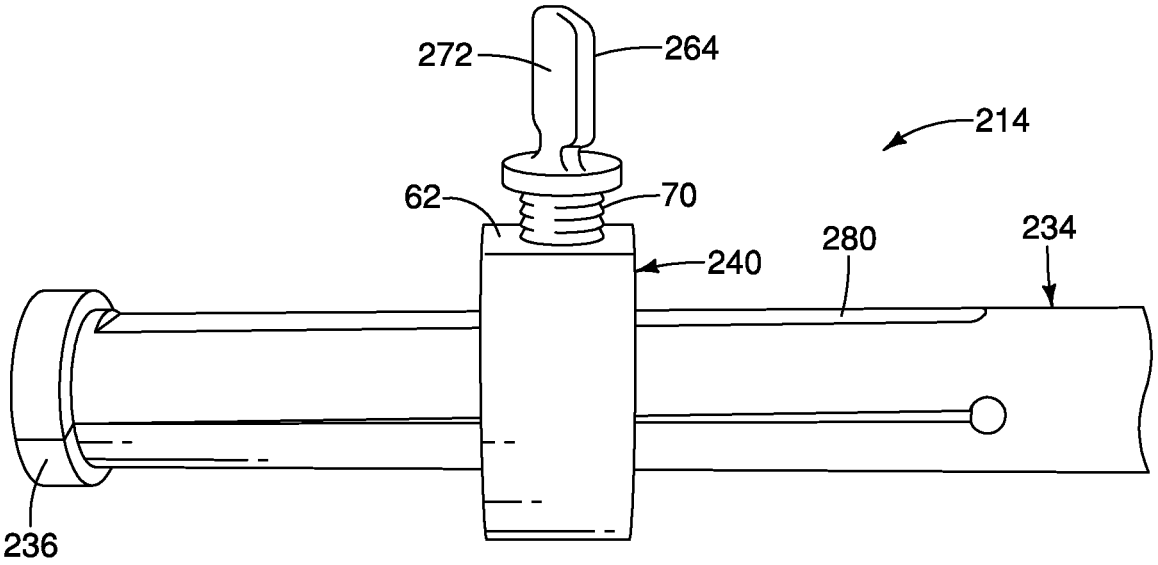
FIG. 19 is a perspective view of a tightening tool showing a modified elongated member and a clamping assembly in accordance with a third embodiment.
Figure 20:
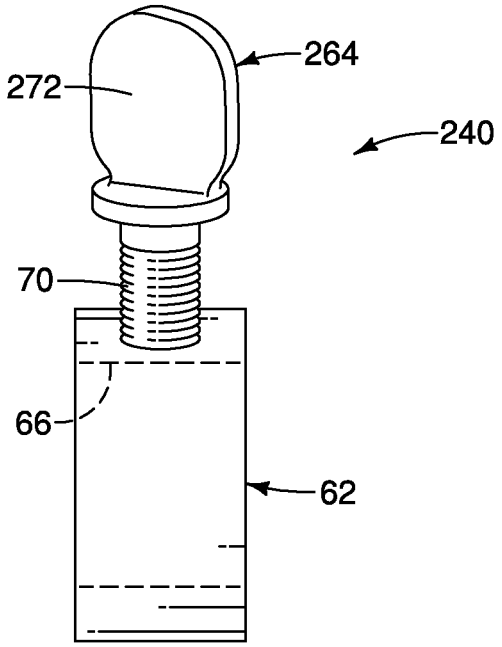
FIG. 20 is a side view of the clamping assembly removed from the tightening tool in accordance with the third embodiment.
Figure 21:
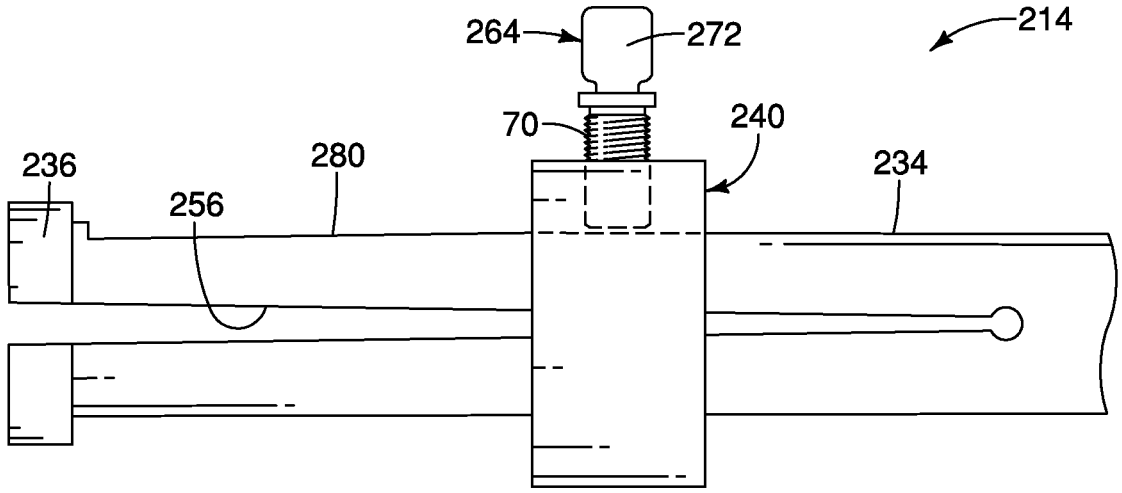
FIG. 21 is a side view of the tightening tool in accordance with the third embodiment.

Referring now to FIGS. 19-21, a tightening tool 214 having an elongated member 234 and a clamping assembly 240 in accordance with a third embodiment will now be explained. In view of the similarity between the first and third embodiments, the parts of the third embodiment that are identical to the parts of the first embodiment will be given the same reference numerals as the parts of the first embodiment. Moreover, the descriptions of the parts of the third embodiment that are identical to the parts of the first embodiment may be omitted for the sake of brevity.

In the third embodiment, as shown in FIGS. 19 and 21, the elongated member 234 includes a retaining portion 236 that replaces the removable retaining member 36 of the first embodiment. Specifically, the retaining portion 236 (also referred to as a stop portion) is formed with the elongated member 234. For example, if the elongated member is a molded plastic construct, the retaining portion 236 can be molded as a unitary monolithic portion of the elongated member 234. If the elongated member 234 is made of a resilient, flexible metal, the retaining member 236 can be machined out of the blank of metal used to form the elongated member 234.

The elongated member 234 is partially bored out to form the semi-hollow interior as described above with respect to the elongated member 34 of the first embodiment. The elongated member 234 of the third embodiment further include at least one slot 256 but alternatively can include two slots 256 in a manner similar to the second embodiment. The elongated member 234 also includes a flat surface 280 formed on a portion of the cylindrically shaped outer surface of the elongated member 234. The flat surface 280 is positioned and dimensioned to interact with the clamping assembly 240, as is described below. Although not shown, the elongated member 334 includes the wrench attachment end 38 as described above with respect to the first embodiment.

As shown in FIGS. 19-21, the clamping assembly 40 of the first embodiment is replaced with the clamping assembly 240 of the third embodiment. The clamping assembly 240 includes the first member 62 of the first embodiment and a second member 264. The first member 62 is as described above with respect to the first embodiment and includes the central opening 66 and the threaded bore 68. The second member 264 includes the threaded portion 70 of the first embodiment and a flange portion 272. The flange portion 272 and the threaded portion 70 are preferably manufactured as a single, solid, uniform member. The flange portion 272 is shaped and dimensioned to be loosened and/or tightened by the fingers and hands of an operator or technician using the tightening tool 214.

The flat surface 280 is dimensioned and positioned such that the distal end of the second member 264 of the clamping assembly 240 engages (contacts) the flat surface 280 when the second member 264 is tightened to clamp the elongated member 234.

The vehicle features and structures (other than the tightening tools 14 and 214) are conventional components that are well known in the art. Since features are well known in the art, these structures will not be discussed or illustrated in detail herein. Rather, it will be apparent to those skilled in the art from this disclosure that the components can be any type of structure that can be used to carry out the present invention.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiments, the following directional terms "forward", "rearward", "above", "downward", "vertical", "horizontal", "below" and "transverse" as well as any other similar directional terms refer to those directions of a vehicle equipped with the tightening tool. Accordingly, these terms, as utilized to describe the present invention should be interpreted relative to a vehicle equipped with the tightening tool.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such features. Thus, the foregoing descriptions of the embodiments according to the present invention are provided for illustration only, and not for the purpose of limiting the invention as defined by the appended claims and their equivalents.

What is claimed is:

1. A rod tightening tool, comprising an elongated member having a semi-hollow interior and defining an opening at one end thereof providing access to the semi-hollow interior, the elongated member having a slot formed along a portion thereof that extends to the semi-hollow interior;

a clamping assembly having a first member and a second member, the first member installed for sliding movement along an exterior surface of the elongated member, the second member being installed to the first member such that the first and second members clamp to the elongated member; and a wrench attachment end fixedly attached to the elongated member.

2. The rod tightening tool according to claim 1, wherein the semi-hollow interior of the elongated member is dimensioned to receive an elongated rod therein such that the clamping assembly clamps the elongated member to the elongated rod.

3. The rod tightening tool according to claim 1, wherein the slot of the elongated member has a first width proximate the opening in the absence of clamping force by the clamping assembly and with clamping force being applied by the clamping assembly to the elongated member, the width of the slot proximate the opening is reduced to a second width is narrower than the first width.

4. The rod tightening tool according to claim 1, wherein the elongated member has an overall cylindrical shape, and the first member of the clamping assembly has an annular shape with a central opening dimensioned to receive and slide along the elongated member in the absence of clamping force from the clamping assembly.

5. The rod tightening tool according to claim 4, wherein the first member of the clamping assembly includes a radially extending opening that extends from an outer surface of the first member to the central opening, the radially extending opening being dimensioned to receive the second member.

6. The rod tightening tool according to claim 5, wherein the radially extending opening includes internal mechanical threads, and the second member includes external mechanical threads that mate and thread into the internal mechanical threads of the radially extending opening of the first member of the clamping assembly.

7. The rod tightening tool according to claim 1, wherein the wrench attachment end is configured to receive a wrench for applying torque to the elongated member.

8. The rod tightening tool according to claim 7, wherein the wrench attachment end has a hexagonal shape.

9. The rod tightening tool according to claim 1, wherein the elongated member includes a recess that extends around the outer surface of the elongated member proximate the opening, with a retaining member installed to the recess.

10. The rod tightening tool according to claim 9, wherein the retaining member is made of an elastic material.

11. The rod tightening tool according to claim 9, wherein the retaining member is an elastic C-type ring that includes a gap.

12. The rod tightening tool according to claim 9, wherein the retaining member is dimensioned and positioned to stop sliding movement of the clamping member proximate the opening.

13. The rod tightening tool according to claim 1, wherein the slot of the elongated member includes a pair of slots defined along opposite sides of the elongated member parallel to one another.

14. A rod tightening tool, comprising an elongated member having a first end, a second end and a cylindrically shaped outer surface that defines a semi-hollow interior with an opening at the first end thereof, the elongated member having a slot formed along a portion thereof that extends to the semi-hollow interior and the opening;

a clamping assembly having a first member and a second member, the first member having a central opening dimensioned to receive the elongated member such that the first member is slidable along the cylindrical surface, the second member being installed to the first member such that the first and second members clamp to the elongated member; and a wrench attachment end fixedly attached to the second end of the elongated member.

15. The rod tightening tool according to claim 14, wherein the semi-hollow interior of the elongated member is dimensioned to receive an elongated rod therein such that the clamping assembly clamps the elongated member to the elongated rod.

16. The rod tightening tool according to claim 14, wherein the first member of the clamping assembly includes a radially extending opening that extends from an outer surface of the first member to the central opening, the radially extending opening being dimensioned to receive the second member.

17. The rod tightening tool according to claim 16, wherein the radially extending opening includes internal mechanical threads, and the second member includes external mechanical threads that mate and thread into the internal mechanical threads of the radially extending opening of the first member of the clamping assembly.

18. The rod tightening tool according to claim 14, wherein the wrench attachment end has a hexagonal shape configured to receive a wrench for applying torque to the elongated member.

19. The rod tightening tool according to claim 14, wherein the elongated member includes a recess that extends around the outer surface of the elongated member proximate the opening, with a retaining member installed to the recess.

20. The rod tightening tool according to claim 19, wherein the retaining member is made of an elastic material and is dimensioned and positioned to stop sliding movement of the clamping member proximate the opening.

* * * * *